US005347720A

United States Patent [19]

Pereira

[11] Patent Number: 5,347,720

[45] Date of Patent: Sep. 20, 1994

[54] CAN OPENER

[76] Inventor: Joseph A. T. Pereira, 388 Woodham Lane, Weybridge, Surrey, KT15 3NT, Great Britain

[21] Appl. No.: 14,193

[22] Filed: Feb. 3, 1993

[30] Foreign Application Priority Data

Aug. 3, 1990 [GB] United Kingdom ..... 9017098
May 31, 1991 [GB] United Kingdom ..... 9111720

[51] Int. Cl.[5] ..... B67B 7/46; B67B 7/54; B67B 7/68

[52] U.S. Cl. ..... 30/422; 30/416; 30/426

[58] Field of Search ..... 30/416, 420, 422, 424, 30/425, 426

[56] References Cited

U.S. PATENT DOCUMENTS

| | | | |
|---|---|---|---|
| Re. 27,504 | 10/1972 | Smith et al. . | |
| 2,661,528 | 12/1953 | Coplen | 30/416 |
| 4,734,986 | 4/1988 | Peters | 30/426 |
| 4,782,595 | 11/1988 | Porucznik et al. | 30/422 |
| 4,833,783 | 5/1989 | Davec | 30/416 |
| 5,181,322 | 1/1993 | Koo | 30/426 |

FOREIGN PATENT DOCUMENTS

| | | |
|---|---|---|
| WO85/03280 | 8/1985 | PCT Int'l Appl. . |
| WO90/05108 | 5/1990 | PCT Int'l Appl. . |
| 986043 | 3/1965 | United Kingdom . |

*Primary Examiner*—Richard K. Seidel
*Assistant Examiner*—Paul M. Heyrana, Sr.

[57] ABSTRACT

The invention relates to a can opener which removes the lid (E) of a can by cutting through an outer part of the rim (R) of the lid. The can opener comprises two body portions arranged for relative pivotal movement about an axis, one portion carrying a rotary cutting wheel (10) and the other portion carrying a rotary traction wheel (12). The latter is shaped to distort the rim of the can while it is being cut by the cutting wheel whereby the overlapping engagement between the end wall of the can and the side wall of the can is loosened. To distort the rim, the traction wheel includes a portion having a surface adapted to engage, in use, the inner side wall of the rim, the said surface being inclined at an angle greater than the angle of the inclination of the rim with respect to the vertical axis of the can.

14 Claims, 7 Drawing Sheets

CAN OPENER

The invention relates to a can opener of the type which operates to separate an end wall or lid of the can by cutting from the outside into the upstanding rim formed at the end of the can and comprising overlapped portions of the perimeter of the end wall and the side-wall of the can.

A can opener of this type is disclosed in European patent publication EP-A-169224. That opened comprises two pivotally arranged body portions, one carrying a cutter wheel and the other a traction wheel, and the rim of the can be to opened is in use of the opener received between the wheels. The axes of the wheels are substantially parallel. A problem can arise with that opened in that even when the opener has cut around the entire periphery of the rim, it can still be difficult to remove the severed end wall. It is proposed in that disclosure to provide means separate from the cutter wheel to detach the severed end wall. For this purpose the opened, in one embodiment, includes an extra release hook, and in another embodiment, a laser which distorts the side wall of the can.

This invention is based on the realisation that by appropriate shaping of the parts supporting the rim of the can, the end wall can be cut so that it may be easily detached from the can.

In one aspect the invention provides a can opener adapted to separate an end wall from a can body by cutting from the outside into the upstanding rim formed at the end of the can, the rim comprising overlapped portions of the perimeter of the end wall and the side wall of the can, the can opener comprising two body portions arranged for relative pivotal movement about an axis, one portion carrying a rotary cutting wheel and the other portion carrying a rotary traction wheel, the axes of the wheels being substantially parallel in one vertical plane, the opener being arranged, in use, to receive the rim of the can between the two wheels and to orbit the can as the traction wheel is rotated while the cutting wheel makes a peripheral cut into the outside of the rim, the traction wheel being shaped to distort the rim while it is cut by the cutting wheel to loosen the overlapping engagement between the end wall and the side wall of the can.

Preferably, to distort the rim, the traction wheel includes a portion having a surface adapted to engage, in use, the inner side wall of the rim, the said surface being inclined at an angle greater than the angle of the inclination of the rim with respect to the vertical axis of the can.

A pair of spaced shoulders, are preferably arranged to contact the rim of the can and to orient the rim at a dive angle (defined hereafter) relative to the cutting edge of the cutting wheel. One of the shoulders is preferably a flange on the traction wheel.

Embodiments of the invention will now be described by way of example, with reference to the accompanying diagrammatic drawings in which.

Figure 4:
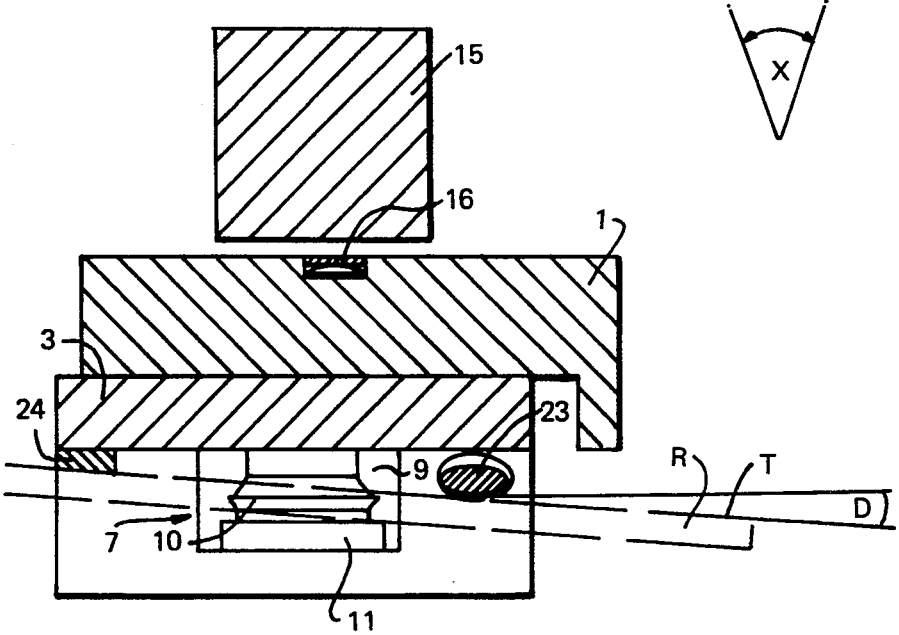
FIG. 4 is a cross-sectional view along line B—B of FIG. 2.
Figure 5:
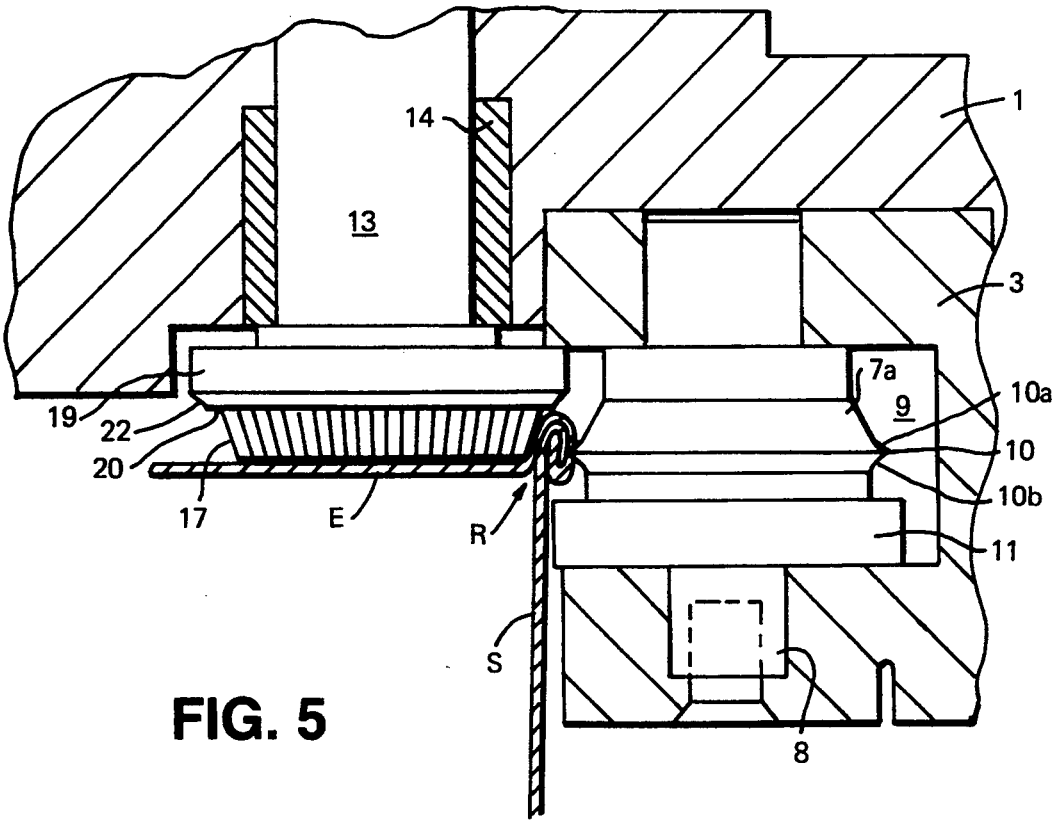
FIG. 5 is a view to an enlarged scale of part of FIG. 2, but also showing a can rim in the cutting position.
Figure 6A:
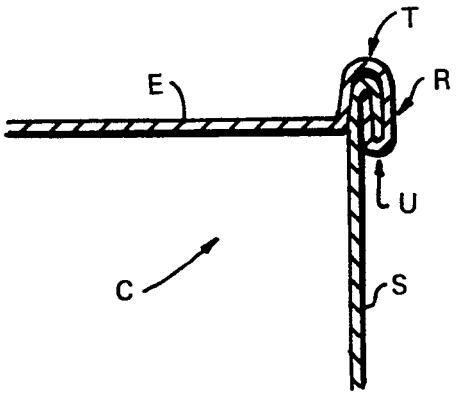
Figure 6B:
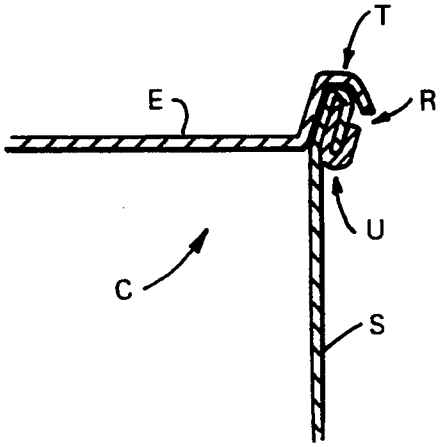
Figure 7:
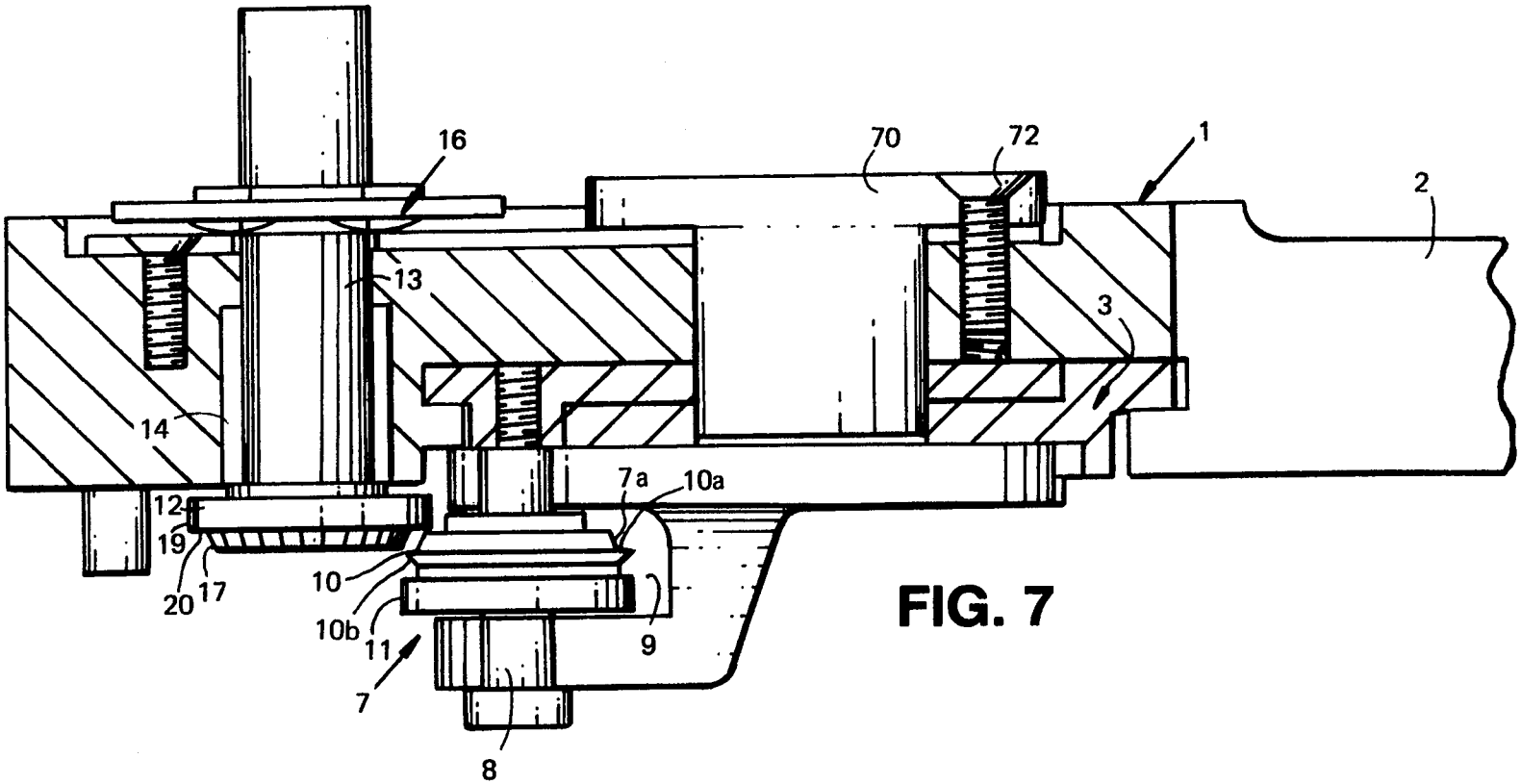
Figure 8:
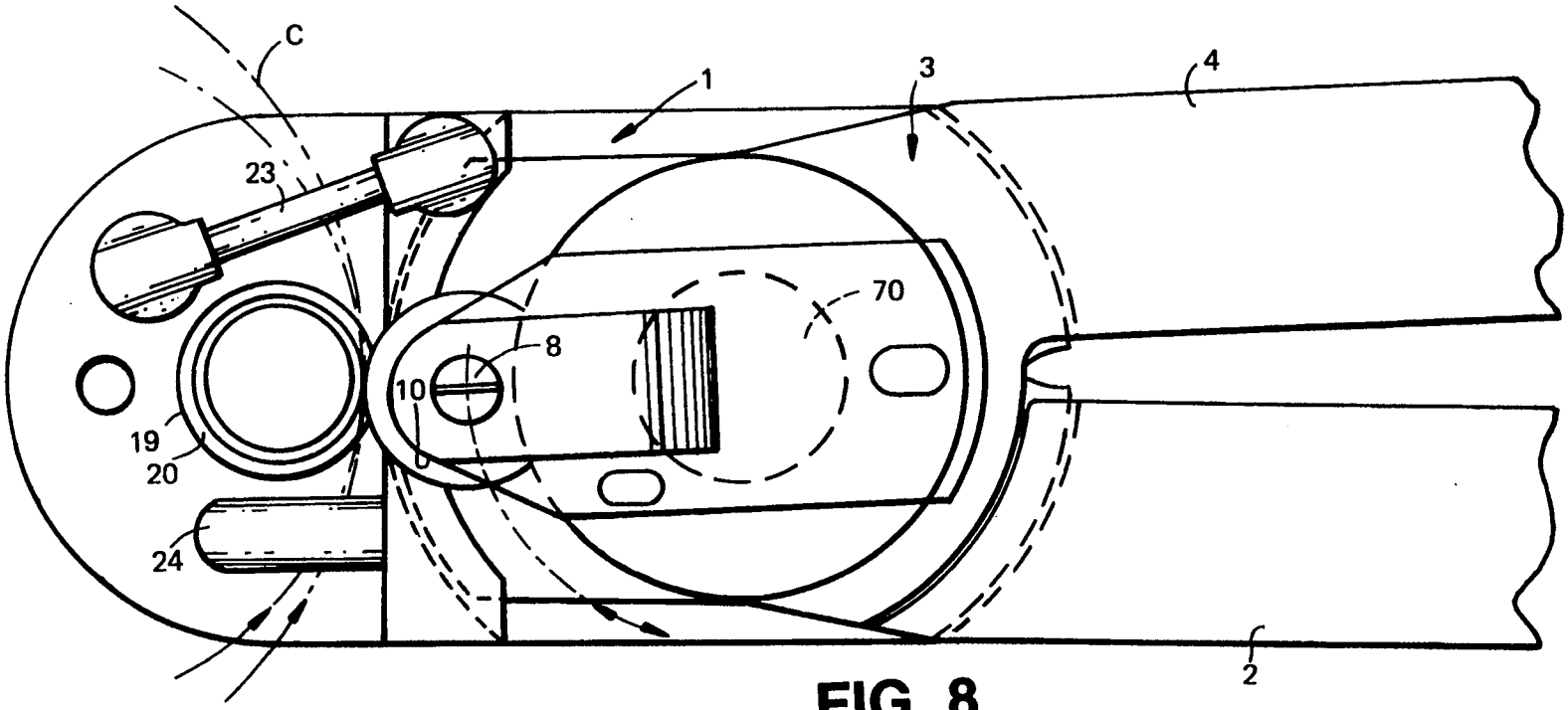
Figure 9:
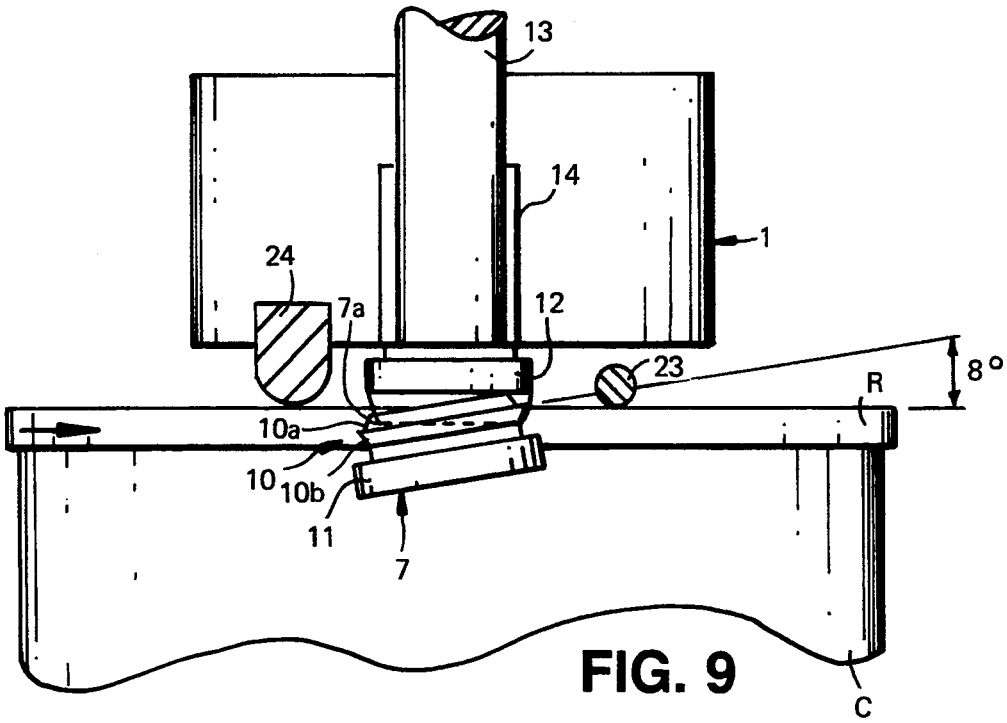
Figure 10:
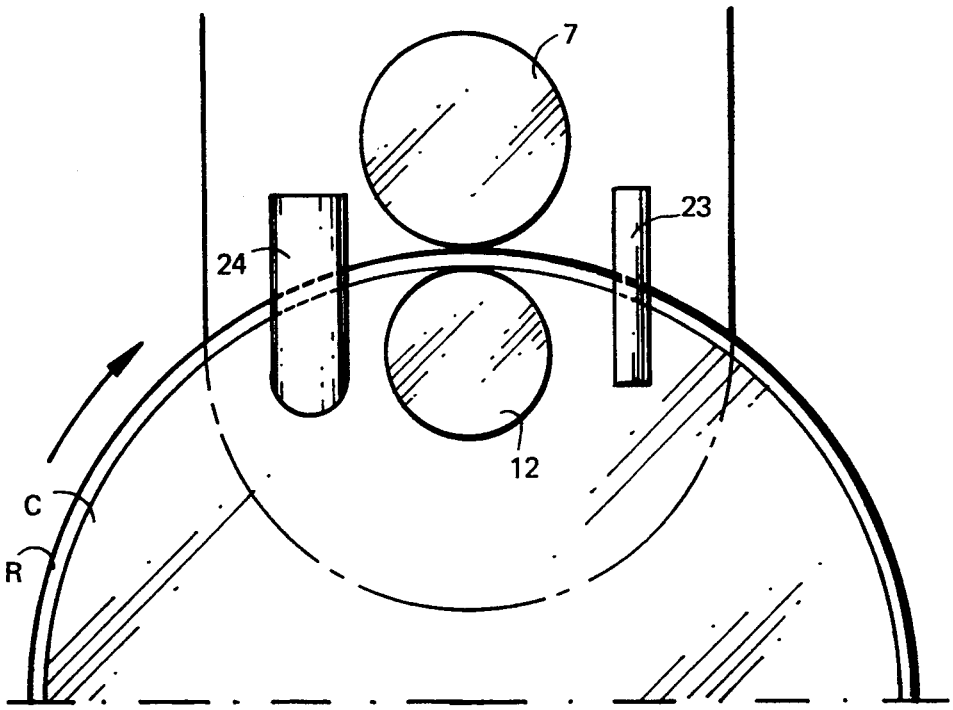
Figure 11:
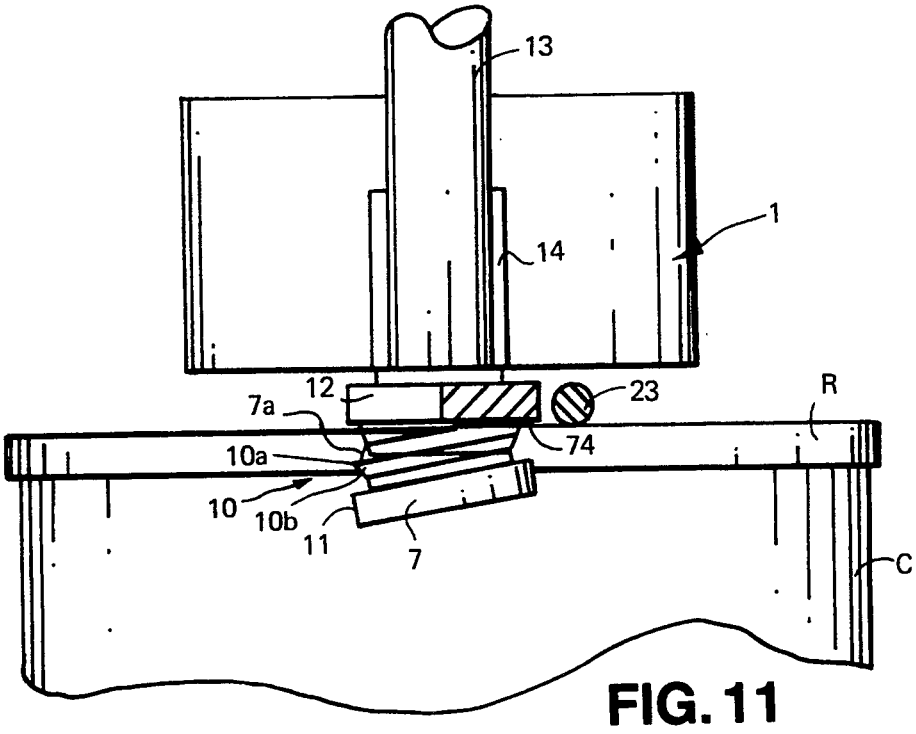
Figure 12:
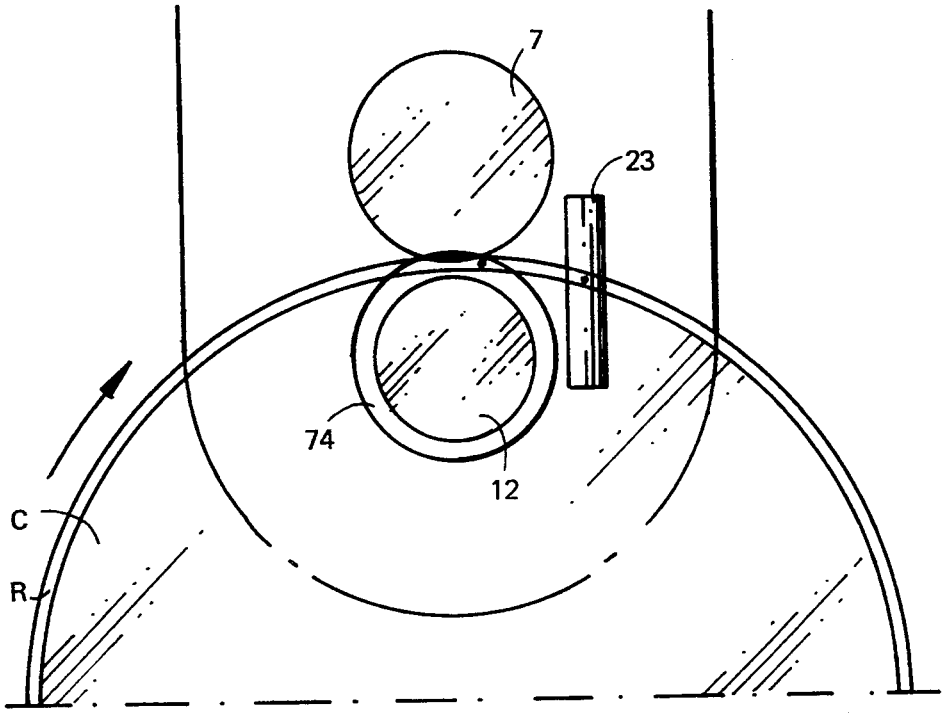

FIG. 6*a* is a partial sectional view showing a can rim before, and FIG. 6*b* is the same view after, cutting using the can opener of FIGS. 1 to 5;

FIG. 7 is a cross-section through a second can opener embodying the invention;

FIG. 8 is an underneath plan of the can opener of FIG. 7;

FIGS. 9 and 10 are a schematic elevation and a top view plan, respectively, of one arrangement for orienting the cutting in the can opener of FIG. 7; and FIGS. 11 and 12 are a schematic elevation and a top view plan, respectively of an alternative arrangement for orienting the cutting in the can opener of FIG. 7.

The can C to be opened, as best seen in FIG. 6*a*, includes a peripheral upstanding rim R, having an upwardly facing topmost portion T and a downwardly facing underside portion U. The rim R is formed from overlapped portions of the periphery of the end wall E of the can and the end portion of the side wall S of the can.

Figure 1:
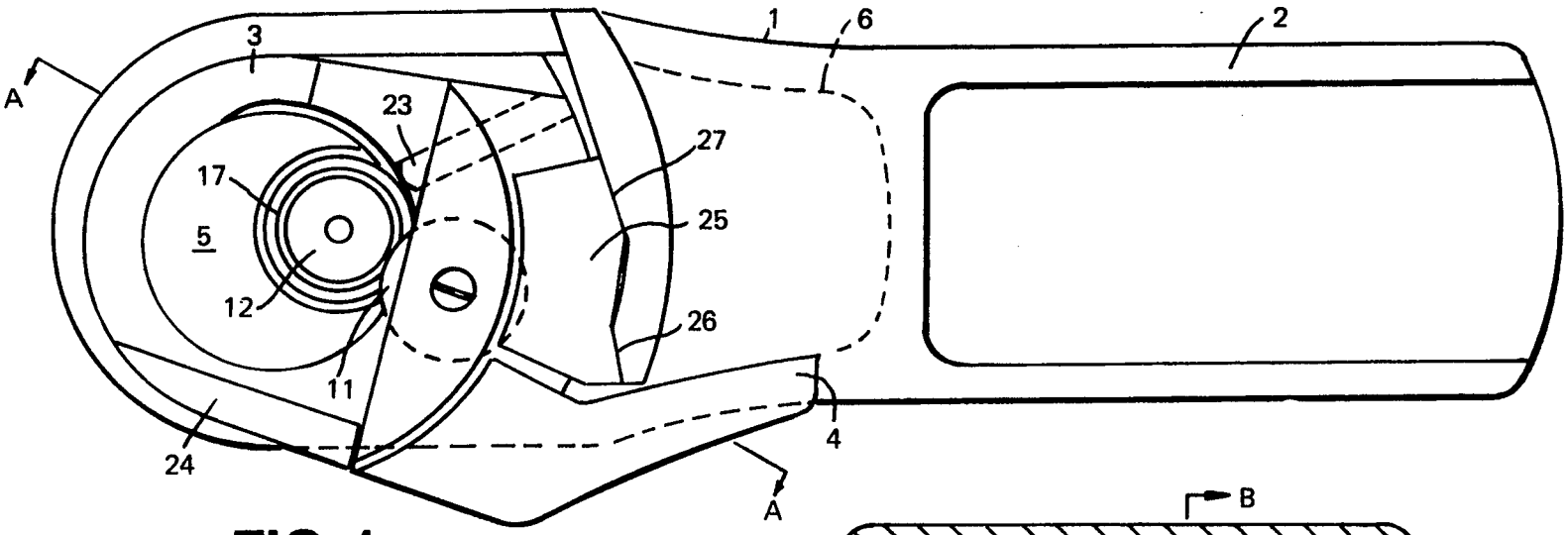
FIG. 1 is an underneath plan view of a can opener embodying the invention.
Figure 2:
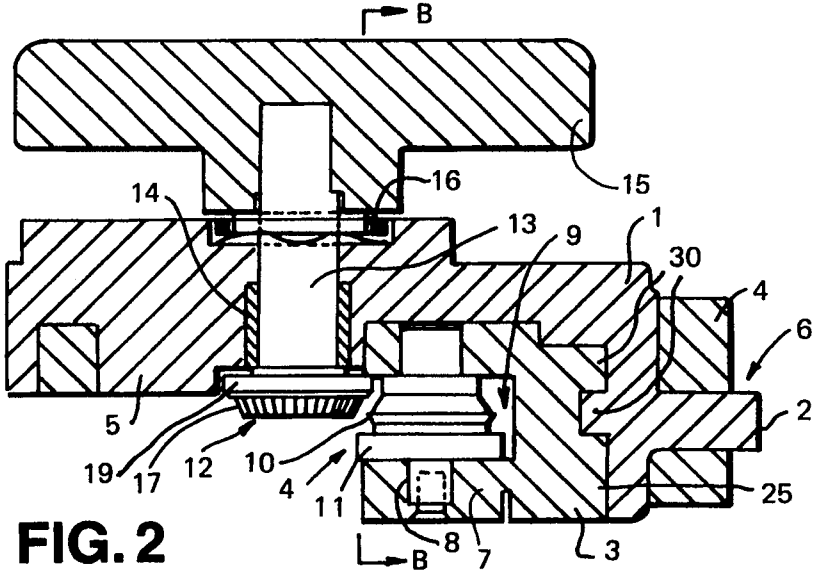
FIG. 2 is a cross-sectional view along line A—A of FIG. 1.
Figure 3:
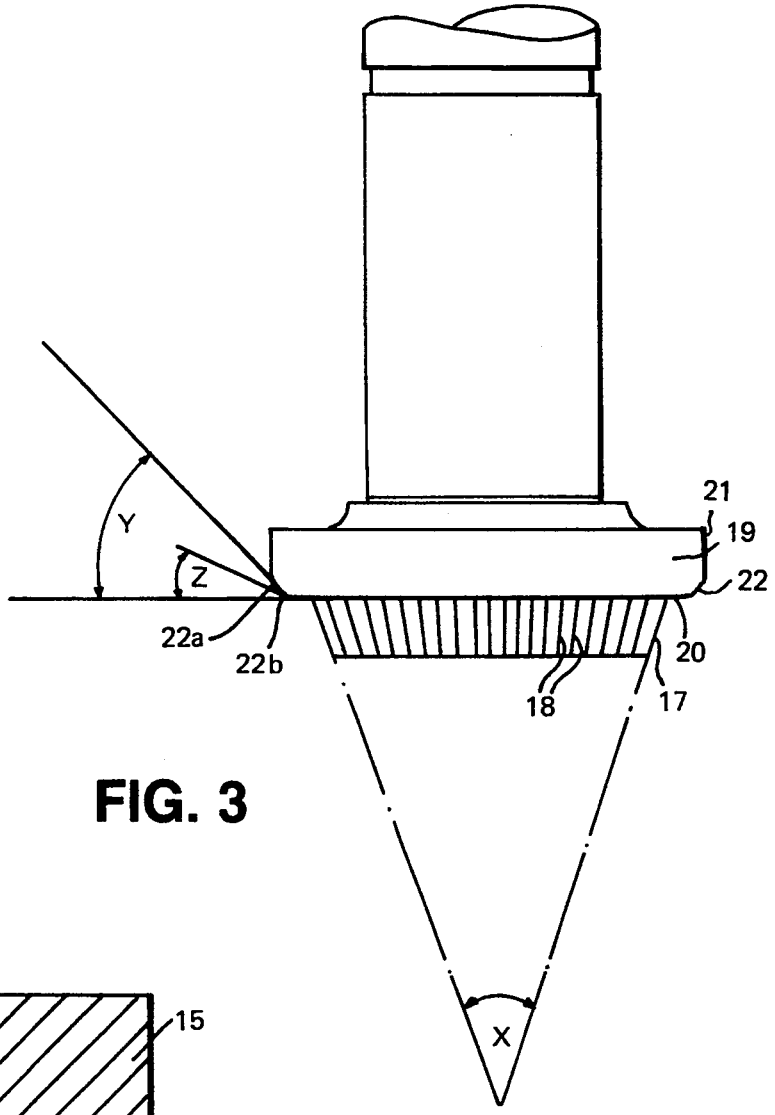
FIG. 3 is a side view of part of the traction wheel shown in FIG. 2, but drawn to an enlarged scale.

The can opener shown in FIGS. 1 and 2 of the drawing is designed to be held in one hand of a user and comprises a first body portion 1 of relatively large size having a handle portion 2, and a second relatively smaller body portion 3 having a thumb grip portion 4. The two body portions 1, 3 are separately moulded of plastics and are joined in superimposed pivotal relation by means of a spigot 5 on the first portion 1 which projects into a corresponding hole in the second body portion 3.

The two body portions of the can opener 1, 3 are pivotally movable relative to one another between a relatively closed condition, shown in the drawings, in which the thumb grip 4 lies flush against the handle 2 of the first portion 1 and a relatively open condition, not shown in which the thumb grip 4 extends away and to one side. The first body portion 1 includes, as shown, a recess 6 in the topmost surface of the handle portion 2 at one side of where the thumb grip 4 lies in the closed condition. When the thumb grip portion 4 is in the closed condition the user can grip the handle 2 with his thumb in the recess and flick the thumb grip sideways from the closed to the open condition.

A cutter wheel 7 is rotatably mounted upon a pin 8 within a recess 9 on the second body portion 3. The cutter wheel 7 includes an annular cutting body 10 about midway up its height which protrudes beyond the recess 9, and a lowermost outwardly extending flange 11. The body 10 comprises two ram portions 10*a* and 10*b*, FIG. 5 which converge to define the cutting edge. The portions are asymmetrical, i.e. the topmost portion 10*a* is inclined at a very shallow angle, e.g. about 5 degrees to the horizontal plane, while the lowermost portion 10*b* is inclined at a relatively steeper angle of between about 45 degrees and about 60 degrees to the horizontal plane, preferably about 55 degrees. Such an arrangement has been found to give a durable cutting edge which requires a reasonable force to make a cut. Above the portion 10*a* the cutter wheel includes a further inclined portion 7*a* to provide a clearance between the cutter and the traction wheel, to be described later on.

A traction wheel 12 includes a pin 13 which extends eccentrically through the spigot 5. The pin 13 rotates within a sleeve 14. A T-shaped handle 15 is secured to the top of the pin 13 for rotating the traction wheel 12 and a circlip and spring washer arrangement 16 is present in between the lowermost face of the handle 15 and the opposing face of the first body portion 1. The traction wheel 12 comprises an inverted frusto-conical portion 17, best seen in FIG. 3, having an included angle X of between about 30 degrees and about 50 degrees, preferably about 40 degrees, so that the content face thereof makes an angle of between about 15 degrees and 25 degrees with respect to the vertical axis of the can being opened, as will be explained below.

The majority of cans currently available include a rim R having an inner face that diverges from the vertical axis of the can at an angle of about 10 degrees. We have discovered that by shaping the frusto-conical portion 17 of the traction wheel such that the rim R is bent or otherwise moved outwardly at an angle of greater than this angle during cutting, any remaining frictional engagement between the walls of the rim on each side of the cut is broken. The bending action will also tend to break any glue or like sealant present in the rim or, say, a plastics or like lining within the can. Accordingly, the angle of inclination of the portion 17 is selected to be at least greater than about 10 degrees. The maximum angle of inclination should be less than that which so bends the rim that it makes the traction wheel difficult to turn, which is of especial importance where the can opener is of the hand operated variety.

The frusto-conical portion 17 includes ribs 18 to provide grip. A flange 19 of greater diameter is present above the frusto-conical portion 17. The flange 19 includes an underlying substantially horizontal annular surface 20. The vertical spacing between the underlying surface 20 and the uppermost face of the flange 11 is selected to be greater than the height of the rim on the can to be opened. The underlying surface 20 is joined to the outermost facing side wall 21 of the flange by an inclined portion or corner 22. The inclined corner 22 comprises an outermost portion **22*a* inclined at a relatively greater angle Y, e.g. about 45 degrees to the underlying surface 20, and an innermost portion 22*b*** inclined at a relatively smaller angle Z, e.g. about 30 degrees.

Although, as shown, the two portions are generally planar, the corner may be radiused or otherwise curved. A pair of vertically offset, horizontally spaced apart shoulders 23, 24, separate from the traction and cutter wheel, best seen in FIGS. 1 and 4, is present on the underlying face of the second body portion 3. The shoulders 23, 24 contact, in use, the topmost surface T of the rim R and; tilt the plane of the can rim relative to the plane of the cutting edge 10 by the so-called dive angle D. One of the shoulders comprises a metal pin 23 projecting towards the traction wheel 12 and disposed so that, when the opener is in the closed condition, the pin 23 is adjacent to and that one side of the point of engagement of the cutter wheel 12 with the rim of the can. The other shoulder 24 comprises an elongate metal plate extending along the outermost edge of the second body portion 3 to the other side of the point of engagement. The relatively side horizontal spacing of the shoulders 23, 24 makes it easy to finely control the dive angle D while, because the shoulders are of metal, they are resistant to wear.

A block portion 25 projects downwardly from the second body portion 3, rearwardly of the cutter wheel 7, and includes two circumferentially spaced apart wedge-like surfaces 26, 27 which co-operate with opposing wedge-like surfaces on the first body portion 1 to limit the engagement of the two body parts when in the closed condition, thereby to prevent undue force being applied to the rim and to maintain the horizontal spacing between the traction and cutter wheels at a fixed distance. The horizontal spacing is selected to be comparable to the thickness of the rim being cut, and arranged so that the cutting edge 10 cuts into the outermost layer of the rim only. The two body portions 1, 3 also include interengaging flanges 30 above the wedge-like surfaces 26, 27 to prevent relative twisting of the body portions 1, 3.

In use, the user initially moves the body portions to the open condition and introduces the rim R of the can C into the space between the traction and cutter wheels, and then the two body portions are moved in nut-cracker-like fashion towards the closed condition shown in the drawings. The shoulders 23, 24 contact the rim R and tilt the can relative to the cutting edge 10 by the dive angle D. The inclined corner 22 of the traction wheel guides the topmost surface T of the rim R downwardly into a position where the frusto-conical portion 17 contacts the inner face of the rim R. The rim of the can is guided along the desired path firstly by inclined surface **22*a* and then inclined surface 22*b***.

As the body portions are further moved to the fully closed condition, the cutting edge 10 contacts and then cuts into an upper portion of the outside of the rim R, which is supported on its inner face by the frusto-conical portion 17, while the underside U of the rim R rests upon the flange 11 of the cutter wheel 7. The wedge-like surfaces 26, 27 provide a lock against excess force being applied to the rim and maintain the horizontal spacing between the traction and cutter wheels at a substantially fixed distance.

As the traction wheel 12 is rotated, because of the dive angle, the cutting edge 10 makes a spiral cut which extends vertically downwardly into the rim until the underside U of the rim is lifted from the flange 11 and the topmost surface T of the rim is urged into contact with the shoulders 23 and 24 of the flange 19 on the traction wheel 12. The cutting wheel will then continue the rest of the cut, inclined at the dive angle D to the top of the rim with the cutting edge 10 tending to separate the cut edges of the end wall E and the side wall S in the manner of an agricultural ploughshare. The frusto-conical portion 17, in cooperation with the shoulders 23 and 24 and the cutting edge 10, exerts a component of force radially and downwardly into the rim thereby to distort or bend the rim R sufficiently to loosen any remaining engagement that the end wall has with the side wall of the can, as best seen in FIG. 5. The opener is then removed from the can and the lid is simply pulled off by hand leaving smooth edges.

A comparison of the can rim before and after opening is shown in FIGS. **6*a* and 6*b*. As shown clearly in FIG. 6*b***, after cutting the rim has been distorted just sufficiently that the end wall E may be lifted from the can body by simple hand operation and without the necessity for extra tool parts.

The arrangement of the relatively short thumb grip portion 4, and the relatively much longer handle portion 2, restricts the level of leverage on the thumb grip portion 4. This is of advantage in this case where, in the closed condition, it is not desirable to provide too great a compressive force into the rim.

In the embodiment illustrated in FIGS. 7 to 12, the body portions 1 and 3 have more or less equal handle portions 2 and 4. The body portions 1 and 3 are pivotally mounted, one to the other, by a pin 70 secured to body portion 1 by machine screws. One of which is shown as 72. In use, the two body portions are moved in scissor-like fashion towards the closed condition shown in the drawings.

Referring to FIGS. 9 and 10 it will be seen that, in contrast to the embodiment of FIGS. 1 to 6, when the shoulders 23 and 24 are in contact with the top of the rim, the axis of the can and the axis of the pin 13 are substantially parallel. These axes are also parallel with the axis of the pin 70 about which the body parts 1 and 3 pivot, so that the general plane of the handles 2 and 4 is parallel to the general plane of the top of the can. This contrasts with the FIG. 4 arrangement where the can is tilted when the opener is level.

A modification is illustrated in FIGS. 11 and 12. Here the shoulder 24 is replaced by a large flange 74 on the traction wheel 12. Since the axis of the traction wheel 12 is parallel to that of the can in this embodiment, there is no requirement to shape the corner of the flange in order to guide the traction wheel convectly. The flange 74 has a chamfer as shown, of an angle of about 30°.

I claim:

1. A can opener adapted to separate an end wall from a can body by cutting from the outside into the upstanding rim formed at the end of the can, the rim comprising over-lapped portions of the perimeter of the end wall and the side wall of the can, the can opener comprising two body portions, arranged for relative pivotal movement about an axis, one portion carrying a rotary cutting wheel and the other portion carrying a rotary traction wheel, the opener being arranged, in use, to receive the rim of the can between the two wheels and to orbit the can as the traction wheel is rotated while the cutting wheel makes a peripheral cut into the outside the rim, wherein the traction wheel is shaped to distort the rim while it is cut by the cutting wheel to cause the rim to move outwardly thereby to loosen the overlapping engagement between the end wall and the side wall of the can;

whereby the traction wheel includes a portion having a frusto-conical surface adapted to engage, in use, the inner side wall of the rim, the surface being inclined at an angle with respect to the vertical axis of the can.

2. A can opener according to either claim 1, wherein the cutting wheel includes an annular cutting edge and an outwardly extending flange is present and disposed below the cutting edge.

3. A can opener according to claim 1, wherein the frusto-conical surface of the traction wheel has an included angle of between about 30 degrees to 50 degrees.

4. A can opener according to claim 3 wherein the frusto-conical surface has an included angle of about 40 degrees.

5. A can opener according to claim 2, wherein the frusto-conical surface of the traction wheel has an included angle of between about 30 degrees to 50 degrees.

6. A can opener according to claim 5, wherein the frusto-conical surface of the traction wheel has an included angle of about 40 degrees.

7. A can opener according to claim 1, wherein the cutter wheel is mounted for rotation about an axis inclined to the pivotal axis of the two body portions.

8. A can opener according to claim 7, wherein the traction wheel is mounted for rotation about an axis parallel to the pivotal axis of the two body portions.

9. A can opener according to claim 1, wherein the traction wheel is mounted for rotation about an axis parallel to the pivotal axis of the two body portions.

10. A can opener according to claim 1, wherein a pair of spaced shoulders, the shoulders being so arranged that when they contact the uppermost surface of the rim at two locations, the plane of the cutting edge of the cutting wheel is oriented at a dive angle in relation to the rim.

11. A can opener according to claim 10, wherein the shoulders are disposed on each side of the traction wheel.

12. A can opener according to claim 11, wherein the shoulders are arranged so that in use the axis of the can and of the traction wheel are substantially parallel.

13. A can opener according to claim 10, wherein the shoulders are arranged so that in use the axis of the can and of the traction wheel are substantially parallel.

14. A can opener according to claim 11, wherein one shoulder is defined by a side portion of the traction wheel and the other shoulder is on the same side of the traction wheel.

* * * * *

UNITED STATES PATENT AND TRADEMARK OFFICE

CERTIFICATE OF CORRECTION

PATENT NO. : 5,347,720
DATED : September 20, 1994
INVENTOR(S) : Pereira

It is certified that error appears in the above-indentified patent and that said Letters Patent is hereby corrected as shown below:

On the title page: Item [73] Assignee: should read -- WILLIAM LEVENE LIMITED , 16/ IMPERIAL DRIVE, HARROW, MIDDLESEX, HA2 7JP, GREAT BRITAIN --.

Signed and Sealed this

Fourth Day of November, 1997

*Attest:*

Bruce Lehman

BRUCE LEHMAN

*Attesting Officer*

*Commissioner of Patents and Trademarks*